United States Patent [19]

Endo et al.

[11] 4,399,779

[45] Aug. 23, 1983

[54] DISTRIBUTOR WITH SLIDING CONTACTS

[75] Inventors: Hiroshi Endo, Yokosuka; Kousaku Baba, Yokohama, both of Japan

[73] Assignee: Nissan Motor Co., Ltd., Yokohama, Japan

[21] Appl. No.: 286,181

[22] Filed: Jul. 22, 1981

[30] Foreign Application Priority Data

Jul. 23, 1980 [JP] Japan ..... 55-99829

[51] Int. Cl.[3] ..... F02P 1/00

[52] U.S. Cl. ..... 123/146.5 A; 123/620; 200/8 R; 200/19 R; 200/24; 200/26; 200/27 A

[58] Field of Search ..... 123/146.5 A, 146.5 R, 123/536, 620; 200/8 A, 8 R, 19 R, 23, 24, 26, 27 A, 28, 144 R, DIG. 7

[56] References Cited

U.S. PATENT DOCUMENTS

| | | | |
|---|---|---|---|
| 1,310,485 | 7/1919 | Lamb . | |
| 2,335,388 | 11/1943 | Conradty et al. | 200/8 R |
| 4,122,816 | 10/1978 | Fitzgerald et al. | 123/620 |
| 4,217,873 | 8/1980 | Nishio et al. | 123/620 |
| 4,269,161 | 5/1981 | Simmons | 123/620 |
| 4,301,782 | 11/1981 | Wainwright | 123/620 |

FOREIGN PATENT DOCUMENTS

| | | |
|---|---|---|
| 2436698 | 3/1975 | Fed. Rep. of Germany . |
| 359186 | 10/1930 | United Kingdom . |
| 433277 | 11/1933 | United Kingdom . |

*Primary Examiner*—Parshotam S. Lall

*Attorney, Agent, or Firm*—Lowe, King, Price & Becker

[57] ABSTRACT

In order to prevent a plasma jet energy from discharging through a spark plug of an internal combustion engine prior to the proper ignition timing, an ignition distributor with a plurality of sliding contacts is proposed. A plasma jet energy as well as a spark energy is selectively delivered to the spark plugs at a predetermined ignition timing through a plurality of contact surfaces mounted on a shaft rotatable in synchronous with the engine crankshaft, thereby an irregular discharge of the plasma jet energy is eliminated.

6 Claims, 8 Drawing Figures

DISTRIBUTOR WITH SLIDING CONTACTS

BACKGROUND OF THE INVENTION

1. Field of the Invention

The present invention relates to an ignition distributor, and more specifically to an ignition distributor for a plasma jet ignition system.

2. Description of the Prior Art

Plasma jet ignition systems are known for extending the misfire limit of an automotive internal combustion engine, in other words, to assure ignition of the combustible charge and assuring a stable combustion when the engine is running under light load conditions or during operation with a lean mixture.

A conventional plasma jet ignition system comprises a spark energy storage system connected via a distributor to ignition plugs to provide a high voltage trigger signal at a predetermined timing to a selective one of the ignition plugs. A plasma jet energy storage system is connected directly to all of the ignition plugs so as to provide plasma jet energy. In operation, the plasma jet energy stored in the plasma jet energy storage system is discharged to that selective spark plug to which the high voltage trigger signal is distributed by the ignition distributor so as to cause a breakdown of the spark gap of the spark plug.

However, this known plasma jet ignition system has suffered from the problem that when the breakdown voltage magnitude decrease, plasma jet energy is discharged through the spark gap of the spark plug prior to proper ignition timing.

SUMMARY OF THE INVENTION

An object of the present invention is to provide an ignition distributor for a plasma jet ignition system, whereby the above mentioned problem is solved.

Another object of the present invention is to provide a plasma jet ignition system overcoming the above mentioned problem.

According to one aspect of the present invention, an ignition distributor is provided wherein a rotor output terminal has a plurality of contact surfaces disposed at predetermined intervals along the axis of rotation. A plurality of fixed circumferentially arranged output terminals about the rotor axis are arranged to cooperate with the contact surfaces respectively as the rotor output terminal rotates, and wherein the rotor output terminal contact surfaces are separated by a plurality of separators of electrically insulating material.

According to another aspect of the present invention, a plasma jet ignition system using such ignition distributor wherein the ignition distributor has its rotor terminal connected to receive not only a high voltage trigger signal from a spark energy storage system, but also a plasma jet energy from a plasma jet energy storage system and the circumferential output terminals are connected to plasma jet ignition plugs, respectively.

DETAILED DESCRIPTION OF PREFERRED EMBODIMENTS

Figure 1:
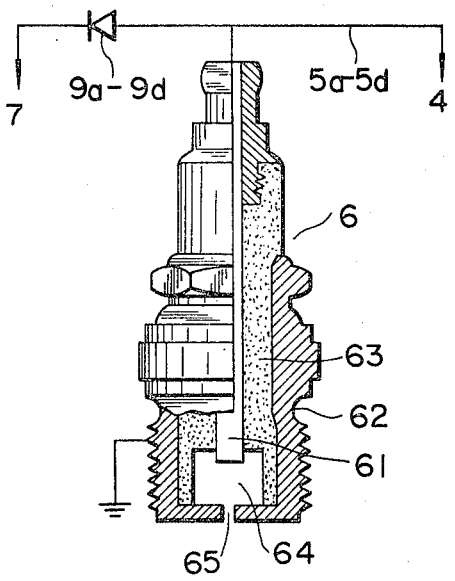
FIG. 1 is a side view, partly in section, of a plasma jet ignition plug.

Before entering into an explanation of the preferred embodiments according to the present invetion, a known plasma jet ignition system equipped with a conventional distributor as well as the problem inherent thereto is explained with reference to FIGS. 1 and 2. As shown in FIG. 1, a spark plug 6 used in a plasma jet ignition system has a center electrode 61, a grounded peripheral electrode 62, and an insulating body of ceramics, which in cooperation with the center electrode 61 and grounded peripheral electrode 62 defines a substantially enclosed discharge cavity 64.

Plasma jet spark plug 6 is supplied with electric energy from both of a spark energy storage system and a plasma jet energy storage system.

When sufficiently high electric potential is applied across the center and grounded peripheral electrodes 61 and 62, causing electrical breakdown of the discharge cavity gap, i.e., sparkgap, the energy stored in the plasma jet energy storage system is dumped into the discharge cavity gap in the form of a discharge current. With sufficient electrical energy supplied to the discharge cavity during a sufficiently short period, a jet of plasma is produced. Thus, plasma jet ignition occurs.

As different from an ordinary spark plug which ignites the mixture only by a spark energy from a spark energy storage system, this plasma jet ignition plug is constructed so that the plasma jet energy is discharged therethrough as well as the spark energy. The ignition of the mixture is effected according to the following sequence.

First, a spark discharge occurs between center electrode 61 and grounded peripheral electrode 62 on the basis of a high tension voltage (−20 to −30 kV) from a spark energy storage system. As a result of a breakdown of discharge cavity 64, the electrically conductive state due to the spark discharge is sustained by applying a relatively low voltage (approximately −2 kV) from the plasma jet energy storage system. As a result, a high temperature high pressure gaseous flow of plasma is generated within discharge cavity 64. This gaseous flow of plasma is ejected to a combustion space through an orifice 65 due to thermal expansion thereof, igniting the mixture igniting the mixture.

Figure 2:
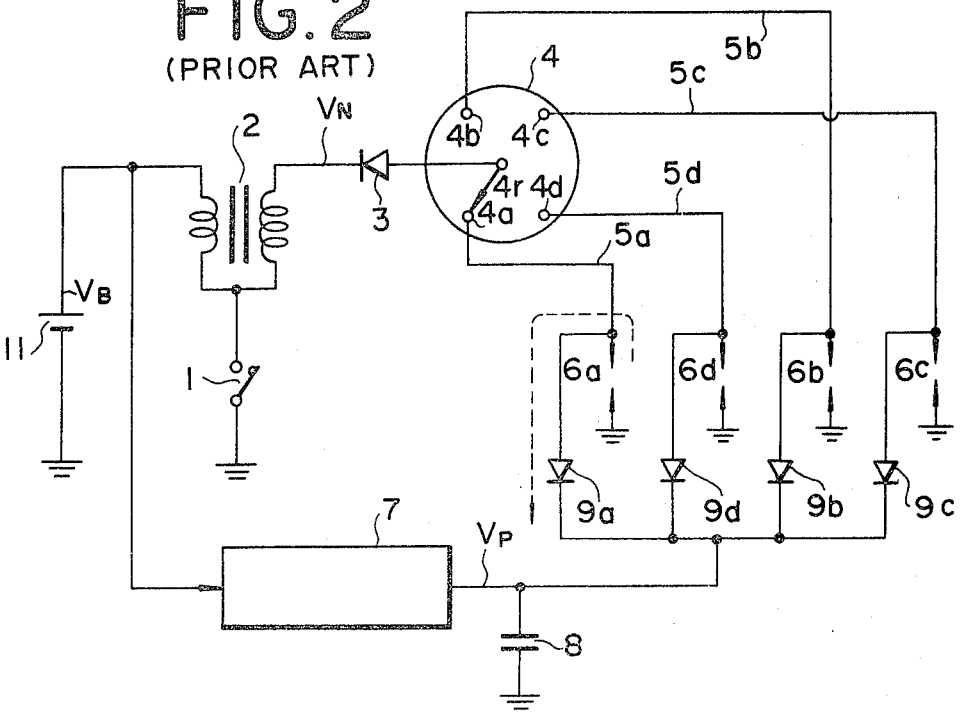
FIG. 2 (PRIOR ART)
FIG. 2 is a diagram of an example of a conventional plasma jet ignition system using a conventional distributor.

The above operation of plasma jet ignition system is explained more specifically with reference to FIG. 2.

FIG. 2 is a schematic diagram of a plasma jet ignition system associated with a four cylinder internal combustion engine, having a plurality of spark plugs 6*a* to 6*d* shown in FIG. 1. In this system, a spark energy storage system includes a storage battery 11, an ignition coil 2, a contact point 1 and a high voltage diode 3. A plasma jet energy storage system includes a plasma jet ignition power source 7, a storage capacitor 8 and a plurality of free wheeling diodes 9*a* to 9*d*.

In operation, current from storage battery 11 flowing through a primary winding of ignition coil 2 is periodically interrupted by a contact point which opens and closes in synchronism with engine rotation. Consequently, a high tension pulse voltage Vn having a peak level of −20 to −30 kV is produced at a secondary winding of the ignition coil. This high tension pulse voltage Vn is supplied to a distributor 4 through diode 3 provided for preventing a high tension pulse voltage Vp of a plasma jet energy storage system from flowing into ignition coil 2. Passing through a discharge gap formed between a rotor 4*r* and one of the stator terminals 4*a* to 4*d* of the distributor 4, this high tension pulse voltage Vn is then supplied in turn to spark plugs 6*a* to 6*d* of respective cylinders via high tension codes 5*a* to 5*d*.

With this high tension pulse voltage Vn, a breakdown of insulation occurs between the electrodes of spark plugs 6*a* to 6*d*, causing a spark discharge to occur between the spark plug electrodes.

In accordance with this breakdown of insulation caused by the spark discharge, electric energy charged within storage capacitor 8 (which has a capacitance value of about 0.5 μF) is dumped into one of spark plugs (6*a* to 6*d* wherein spark discharge has occurred, through one of free wheeling diodes 9*a* to 9*d*. Free wheeling diodes 9*a* to 9*d* are provided to protect the plasma jet energy storage system (which prevents the high tension pulse voltage Vn produced at the secondary winding of the ignition coil 2 from flowing into the plasma jet energy storage system).

A high energy due to this injection of plasma energy produces a high temperature, high pressure gaseous flow, assuming ignition even of a considerably lean mixture.

However, as described hereinabove, since the ignition system with a conventional distributor is constructed so that the plasma jet ignition voltage is continuously applied to all of the spark plugs 6*a* to 6*d* through diodes 9*a* to 9*d*, there is a problem that the discharge of plasma jet energy occurs prior to the proper ignition timing especially when a breakdown voltage is reduced due to a drop in atmospheric pressure within the engine cylinder during an induction stroke of the engine. This irregular discharge causes unstable engine operation, resulting in reduced engine power.

A first embodiment of the present invention is explained hereinafter with reference to FIGS. 3 and 4 of the accompanying drawings.

Figure 3:
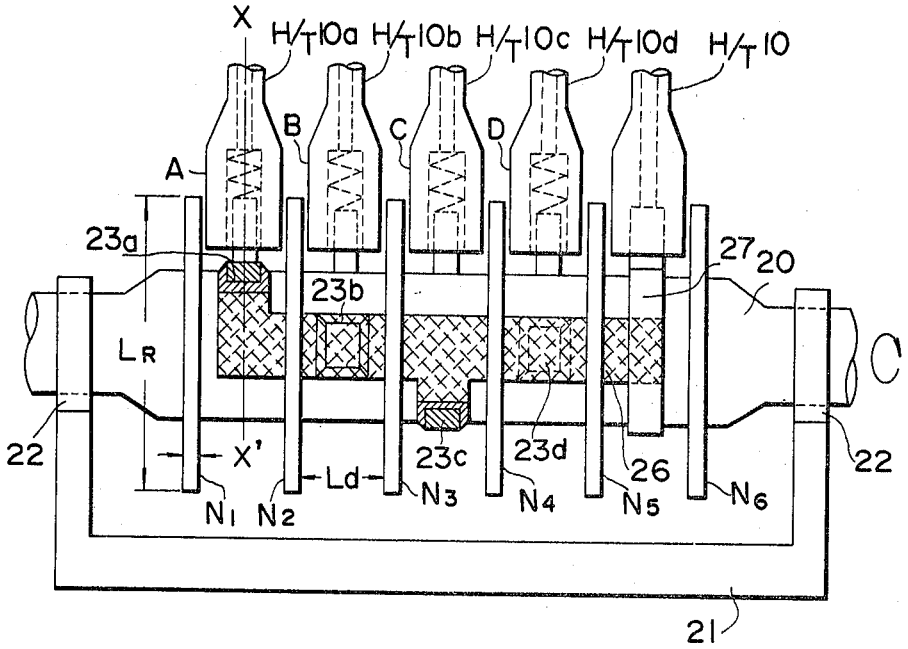
FIG. 3 is a side view of a distributor according to the present invention.
Figure 4:
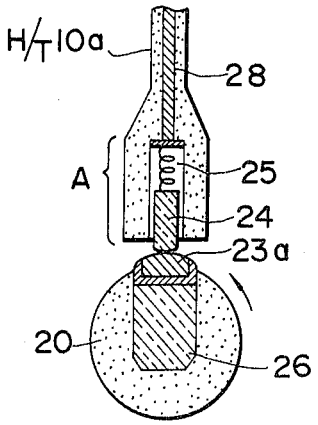
FIG. 4 is a sectional view of the distributor taken along a line X–X′ shown in FIG. 3.

FIG. 3 shows an ignition distributor according to the present invention, and FIG. 4 shows a sectional view of the distributor along a line X–X′ shown in FIG. 3.

The distributor according to the present invention is explained as associated with a four cylinder internal combustion engine. Referring to FIG. 3, a rotor output terminal 26 is supported by a shaft 20 which is made of an electrically insulating material and supported by a supporting plate 21 via a pair of bearings 22 so as to rotate in synchronism with the rotation of engine crankshaft (not shown).

Rotor output terminal 26 has four contact 23*a* to 23*d*, which is equal to the number of engine cylinders. Contacts 23*a* to 23*d* are disposed on outer surface of shaft 20 so that each head portion of the contacts are slightly projected over the outer surface of the shaft, thus defining contact surfaces. In addition, these four contact rollers 23*a* to 23*d* are disposed on shaft 20 at regular intervals with respect to the longitudinal axis thereof and at 90 degrees angularly displaced positions about the shift axis. A plurality of separators $N_1$ to $N_6$ of insulating material are arranged equidistantly in the axial direction of shaft 20 so as to prevent a leak current between adjacent contacts. Each of contacts 23*a* to 23*d* is disposed between two of adjacent separators $N_1$ to $N_6$. Although not shown, separators $N_1$ to $N_6$ are all fixed and shaft 20 is rotatable relative to the same. Each of contact surfaces of the head portions of contacts 23*a* and 23*d* which projects over the outer surface of the shaft 20 slidably contacts with a corresponding carbon piece 24 of each of brushes A to D, which are electrically connected to core wires, only one being shown in FIG. 4 at 28, of the high tension cords $H/T_{10a}$ to $H/T_{10d}$ through springs 25. Rotor output terminal 26 is electrically connected to a high tension cord $H/T_{10}$ through a slip ring 27.

As will be explained hereinafter with reference to FIG. 5, high tension cord $H/T_{10}$ is connected to both the spark energy storage system and plasma jet energy system. High tension cords $H/T_{10a}$ and $H/T_{10d}$ are respectively connected to the spark plugs 6*a* to 6*d* of each cylinder.

Furthermore, interval $L_d$, width W and diameter $L_R$ of separator members $N_1$ to $N_6$ are determined so as to effect sufficient leak prevention characteristics.

Figure 5:
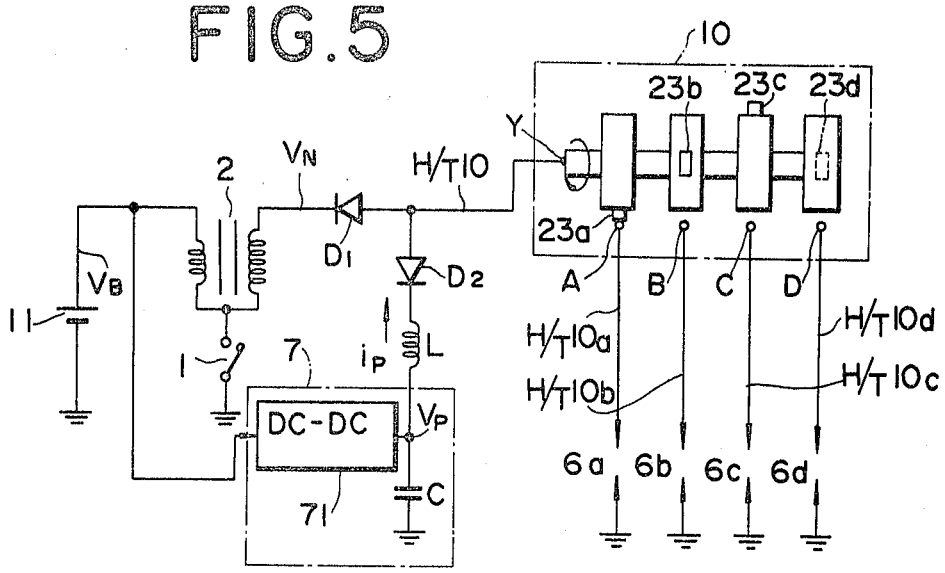
FIG. 5 is a circuit diagram of a plasma jet ignition system using a distributor according to the present invention.
Figure 6:
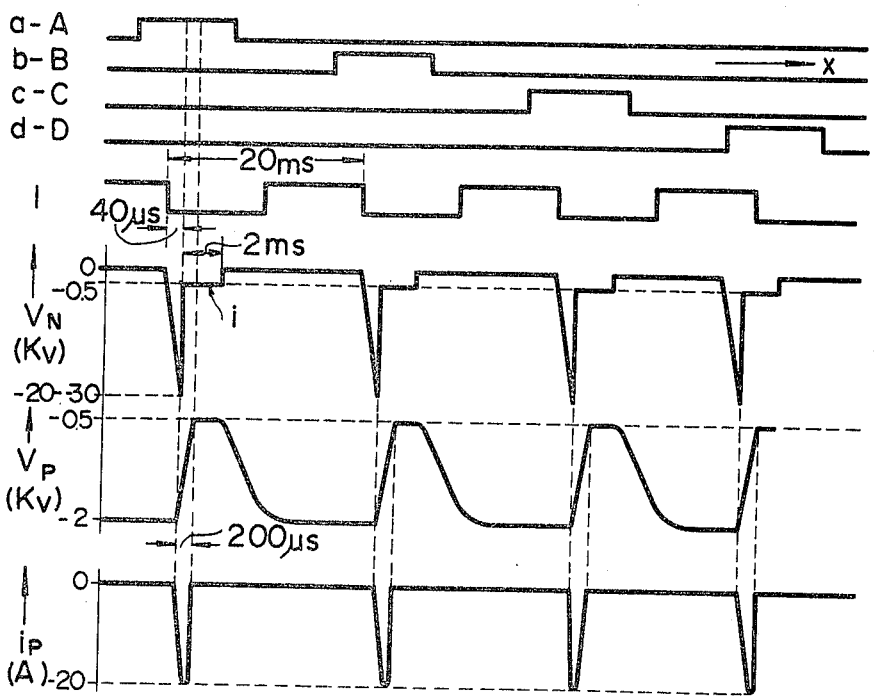
FIG. 6 is a timing diagram of the signals at various portions of the plasma jet ignition system shown in FIG. 5.

FIG. 5 shows a circuit diagram of an arrangement in which the distributor shown in FIGS. 3 and 4 is used for a plasma jet igntion system. FIG. 6 is a timing diagram of signals at various portions of the plasma jet ignition system shown in FIG. 5.

The plasma jet ignition system shown in FIG. 5 features that a high tension pulse voltage $V_N$ from a spark energy storage system is supplied to a high tension cord $H/T_{10}$ connected to distributor 10 through a free wheeling diode $D_1$ and a high tension voltage $V_p$ from a plasma jet ignition power source 7 is also supplied to the same high tension cord $H/T_{10}$ through an inductance L and a free wheeling diode $D_2$.

The operation of the above plasma jet ignition system shown in FIG. 5 is explained hereinafter.

A current flowing through a primary winding of an ignition coil 2 which is applied with a battery voltage $V_B$ is periodically interrupted by a contact point 1 which opens and closes in synchronism with the engine crankshaft rotation.

As a consequence, a high tension pulse voltage $V_N$ having a peak value of −20 to −30 kV and a pulse width of 40 μs is generated at the secondary winding of the ignition coil 2.

This high tension pulse voltage $V_N$ is supplied to slip ring 27 of distributor 10 (shaft 20 thereof rotates with the engine crankshaft rotation) through free wheeling diode $D_1$ and through high tension cord $H/T_{10}$.

This high tension pulse voltage $V_N$ is transmitted through contact 23*a* to brush A to high tension cord $H/T_{10a}$ and to a spark plug 6*a* mounted on the first cylinder. Subsequently, this high tension pulse voltage $V_N$ is supplied through contact 23*b*, brush B, and through high tension cord $H/T_{10b}$ to the spark plug 6*b* mounted on the third cylinder. Then, this high tension pulse voltage $V_N$ is supplied through contact 23*c*, brush C, and high tension cord $H/T_{10c}$ to spark plug 6*c* mounted on the fourth cylinder. Finally, this high tension pulse voltage $V_N$ is supplied through contact 23*d*, brush D, and high tension cord $H/T_{10d}$ to spark plug 6d mounted on the second cylinder.

Thus, the high tension pulse voltage $V_N$ is delivered in turn to spark plugs 6a to 6d by the distributor in accordance with the sequence of 6a, 6b, 6c, and 6d.

In this case, the opening and closing timing of contact point 1 and the operation of the distributor is determined so that the contact point turns off at a center of a period while one of contacts 23a to 23d is in contact with the corresponding one of brushes A to D so as to allow distribution of the high tension pulse voltage $V_N$ and the plasma jet energy to take place within this period.

Once the high tension pulse voltage $V_N$ is fed to one of spark plugs 6a to 6d, a breakdown of insulation occurs between the spark plug electrodes, accompanied by a spark discharge, resulting in occurence of a conductive state between the spark plug electrodes.

At this timing, an electric energy is discharged from capacitor C of 0.5 $\mu$F which stores a high energy (about 1 joule) charged with an output of the DC—DC inverter 71 for boosting the battery voltage (of 12 V) to a DC voltage of $-2$ kV. This high energy is transmitted through the current limiting inductance L, and the free wheeling diode D2, through the high tension cord $H/T_{10}$ connected to distributor 10, then to a passage including a contact, brush, high tension cord, and a spark plug under the spark discharge condition. Thus a high tension energy which has a value of 1 joule is injected between the spark plug electrodes within a very short period of 200 $\mu$S. As a consequence, a high temperature high pressure plasma gas is produced and this gas enables a positive ignition and combustion of the mixture within the cylinder.

A potential level $V_P(-2$ kV) at a terminal of capacitor C is reduced to a voltage of $-0.5$ kV within a short period of 200 s. since the electric charge stored in capacitor C is discharged through a conducted portion formed between the spark plug electrodes when discharge of plasma jet energy occurs after the high tension voltage $V_N$ reaches a peak value thereof.

The current $i_p$ of plasma jet energy which flows into the spark plug reaches a peak value of $-20$ A within this short period.

After completion of injection of high energy followed by an inductive discharge i (see wave shape of $V_N$ in FIG. 6) of the energy stored in ignition coil 2, the electrically conductive state of between the spark plug electrodes is terminated and discharge of the capacitor stops. Therefore, the voltage $V_p$ between the terminal of the capacitor C gradually increases to $-2$ kV as the charging from the DC—DC inverter 71.

Figure 7:
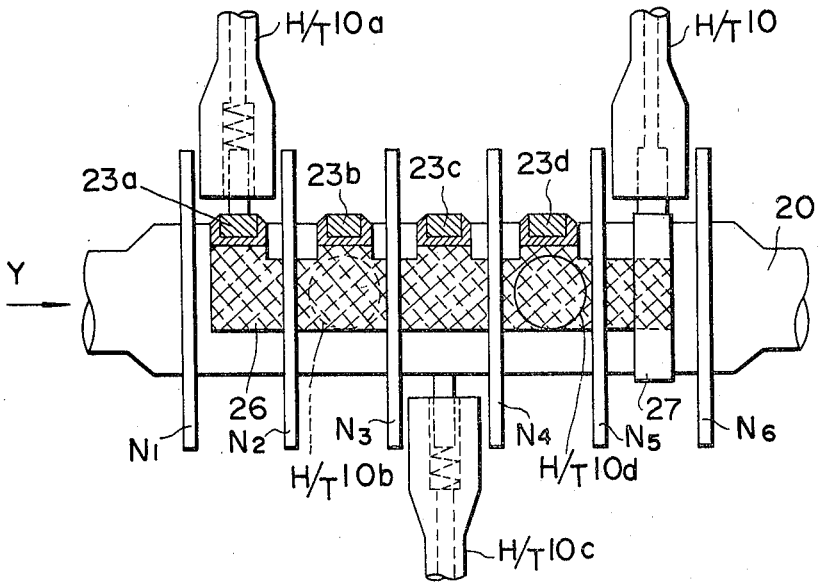
FIG. 7 is a side view, partly in section, of another embodiment according to the present invention.
Figure 8:
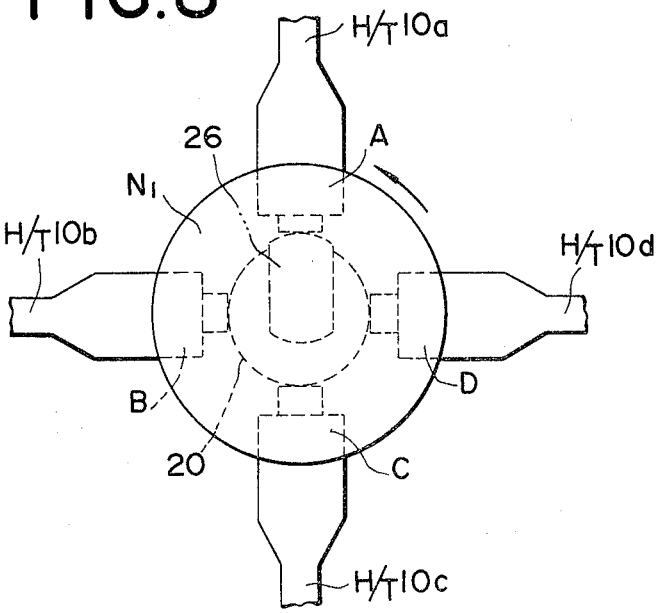
FIG. 8 is an elevational view of the distributor shown in FIG. 7 viewed along an arrow Y.

FIG. 7 shows another embodiment of a distributor with sliding contacts according to the present invention, and FIG. 8 is a side elevation view of the distributor shown in FIG. 7 viewed along arrow Y, in which like reference numerals used in FIGS. 3 and 4 designate the corresponding elements.

This embodiment features that a plurality of contact members 23a to 23d are linearly disposed on the outer surface of shaft 20, and a plurality of brushes and high tension cords $H/T_{10a}$ to $H/T_{10d}$ corresponding to contacts 23a to 23d are arranged at radially spaced positions as shown in FIG. 8.

What is claimed is:

1. An ignition distributor for an ignition system for an internal combustion engine, comprising:

a shaft formed of electrically insulating material rotatable about its axis;

a rotor output terminal disposed within said shaft, said rotor output terminal including a plurality of contact surfaces extending to an outer surface of said shaft;

a plurality of stationary brushes circumferentially disposed about the axis of said shaft and arranged to slidingly contact with the corresponding one of said contact surfaces, respectively, said brushes each being disposed within an insulating housing defined at the end of a high tension cord; and a plurality of separators mounted on said shaft, each separator being arranged to extend from said shaft so as to terminate between two adjacent insulating housings to thereby separate the points of contact between said brushes and said contact surfaces.

2. A distributor as claimed in claim 1, wherein said contact surfaces are disposed to said shaft at regular intervals with respect a longitudinal axis of said shaft, and at equiangular positions around said shaft.

3. A distributor as claimed in claim 1, wherein said contact surfaces are disposed linearly on said shaft.

4. An ignition distributor as claimed in claim 1, wherein said separators are mounted on said shaft so as to be rotatable with respect thereto and held stationary within said distributor.

5. A plasma ignition system for an internal combustion engine, comprising:

a spark energy storage system;

a plasma jet energy storage system;

a plurality of spark plugs arranged to produce a plasma jet discharge; and a distributor connected to said spark energy storage system and said plasma jet energy storage system for delivering a spark energy from said spark energy storage system and a plasma jet energy from said plasma jet energy storage system therethrough to each of said spark plugs in accordance with a predetermined ignition timing, wherein said distributor has sliding contacts and comprises;

a shaft formed of an electrically insulating material rotatable about its axis;

a rotor output terminal disposed within said shaft and electrically connected to said spark energy storage system and said plasma jet energy storage system, said rotor output terminal including a plurality of contact surfaces which extend to an outer surface of said shaft;

a plurality of stationary brushes respectively connected to said spark plugs, circumferentially disposed about the axis of said shaft and arranged to slidingly contact said contact surfaces, respectively, said brushes each being disposed in an insulating housing formed at the end of a high tension cord; and a plurality of insulating separators mounted on said shaft, each separator extending from the shaft and terminating between adjacent insulating housings.

6. A plasma ignition system as claimed in claim 5, wherein said separators are rotatably mounted on said shaft and arranged to be stationary with respect thereto.

* * * * *